United States Patent [19]

Beavers

[11] 4,450,851

[45] May 29, 1984

[54] FREE-STANDING COLLAPSIBLE TENT FRAME STRUCTURE AND HUB ASSEMBLY THEREFOR

[75] Inventor: Allan E. Beavers, Littleton, Colo.

[73] Assignee: T. A. Pelsue Company, Englewood, Colo.

[21] Appl. No.: 330,885

[22] Filed: Dec. 15, 1981

[51] Int. Cl.[3] ..... A45F 1/16

[52] U.S. Cl. ..... 135/109; 135/DIG. 9; 403/171; 403/176; 403/64

[58] Field of Search ..... 135/109, 106, 107, 120, 135/102, 20 M; 211/197; 160/377; 52/86; 403/170–172, 174, 176, 64

[56] References Cited

U.S. PATENT DOCUMENTS

| | | | |
|---|---|---|---|
| 1,575,614 | 3/1926 | Blaw | 403/171 |
| 3,810,482 | 5/1974 | Beavers | 135/109 |
| 3,873,220 | 3/1975 | Kashiwabara | 403/172 |
| 4,369,000 | 1/1983 | Egnew | 403/170 X |

FOREIGN PATENT DOCUMENTS

| | | | |
|---|---|---|---|
| WO79/00176 | 4/1979 | PCT Int'l Appl. | 403/172 |

*Primary Examiner*—Richard J. Apley

*Assistant Examiner*—S. Crow

*Attorney, Agent, or Firm*—Edwin L. Spangler, Jr.

[57] ABSTRACT

This invention relates to an improved free-standing tent frame having at least three four-sided collapsible subframes linked together in side-by-side relation and angled relative to one another so as to stand alone while leaving a gap between the endmost subframes, and a triangularly-segmented roof frame having one more triangular segment than there are subframes in the wall structure. The invention is also characterized by a hub assembly for the subframes of the wall assembly that comprises a series of three or more strut-receiving socket subassemblies hingedly interconnected to produce a closed polygon in which those having four or more sides are self-adjusting to accommodate various included angles between adjacent struts without the latter having to bow or bend. The invention further encompasses the socket subassemblies which employ the hinge pins at opposite ends of the hinge member as keepers to retain the pivot pin of the socket-receiving element in place while the wedge-actuated fingers of the latter releasably grip the hollow strut end without the need for adhesives or more conventional fasteners.

4 Claims, 7 Drawing Figures

FREE-STANDING COLLAPSIBLE TENT FRAME STRUCTURE AND HUB ASSEMBLY THEREFOR

In my U.S. Pat. No. 3,810,482 which is the closest prior art to which I am aware, I disclose a collapsible tent frame having relatively rigid struts radiating from a central hub which cooperate with one another in a fully unfolded overcenter position and within a stretchable cord interconnecting the remote strut ends to define a foldable subframe which in combination with other like subframes will produce a free-standing tent frame. The resulting frame when covered with fabric results in a tent having sidewalls, at least one endwall, and a roof.

In addition to the aforementioned U.S. patent, I have other U.S. patents on collapsible tents of various types such as, for example, those forming the subject matter of U.S. Pat. Nos. 3,941,140; 3,968,809; 4,026,312; 4,077,417; and 4,285,354; however, none of these patents or the references of record therein discloses the unique self-adjusting hub assembly of the instant invention or the strut-receiving subassemblies that are linked together in end-to-end relation to form the latter. Moreover, I now find that by combining three or more upstanding four-sided subframes together in side-by-side relation and angling them so as to leave a gap between the endmost subframes, I am able to bridge this gap with a multi-segmented domed roof-like collapsible frame structure having triangular segments as opposed to the square or rectangular ones I employed heretofore, provided that the triangular segment above the gap is braced with a central rigid hub with braces radiating therefrom to the corners that cooperates with wall frame subassemblies on either side thereof to produce a free-standing arch, and also provided that at least every other triangular roof segment both sides of the one over the gap is similarly braced.

Over the years since my U.S. Pat. No. 3,810,482 issued, I have continued to expand the concept outlined therein and have made various and sundry improvements in the construction of the unit and its hardware. For instance, for some time now I have been using plastic tubing for the struts which, to a limited degree at least, will bow to accommodate other than square and trapezoidal subframe shapes. By using bowable struts, I could elongate the subframes in one direction to a limited degree but when I needed a tent having long walls in relation to the height thereof, the only selection was to place two or more basically square panels in side-by-side relation.

The hub at the center of the subframe was responsible for the limitations on the shape of the subframes because it would only accommodate a single strut arrangement in which essentially fixed included angles (usually 90°) existed therebetween. Any deviation in the frame shape and size predetermined by the hub had to take place by either varying the length of the struts or bowing them. All in all, this hub structure placed severe restrictions upon the options available in the design of these collapsible frames.

Another innovation was to substitute essentially non-stretchable wire rope or cable for the stretchable cord interconnecting the remote strut ends since the latter proved to be difficult to maintain at the required degree of tautness. By using non-stretchable cable with bowable plastic struts, the struts would bend to the degree required to allow the hub to pass from its fully unfolded overcenter position inwardly into a folded one.

Other improvements had to do with the quick-disconnect fastening of the cables to the strut ends, protective shields of one type or another to keep the struts from poking holes in the fabric, and simplified strut end fittings including those at the hub. There remained, however, the ever-present problem of the inability of my previous hub designs to accommodate different included angles between adjacent struts. Along this same line, specific fittings had to be made for other than square or trapezoidal four-sided subframes as well as all polygonal subframes having three or more than four sides.

I have now found in accordance with the teaching of the instant invention that I can make a much more versatile hub by the simple, yet unobvious expedient of hingedly interconnecting three or more strut-receiving socket subassemblies of unique design into a closed polygonal loop. In so doing, all of the polygonal hubs having four or more of such subassemblies linked together are self-adjusting so as to accommodate any angular relation between adjacent strut pairs without the necessity of having the latter bow or bend although to a limited extent at least I still prefer them to do so. While the three-sided hub remains fixed as before, the subassemblies thereof can be interconnected by interposing a spreader plate so as to produce triangular subframes having the included angle between adjacent struts of other than 120°.

The strut-receiving socket subassemblies are unique in and of themselves because the hinge pins passing between the apertured ears on opposite ends of the hinged body cooperate therewith to provide retainers effective to hold the pivot pin-forming elements projecting from the sides of the socket member for pivotal movement within the channel provided therefor. Even the strut-receiving socket itself is specially designed with spreadable internal fingers actuated by a wedge that engage and grip the strut end simply, securely and without the need for adhesives or other fasteners.

I have found it possible using the improved hub assembly to build a collapsible tent frame structure devoid of internal supports having a free-standing sidewall formed of at least four-sided subframes arranged in side-by-side angled relation with a domed triangularly-segmented roof having one more triangular segment than there are wall subframes cooperating with the latter to bridge over an entryway or the like. Such structures can be made quite large, yet, can be both erected and taken down by one person without the use of any tools except, perhaps, a ladder or the like.

It is, therefore, the principal object of the present invention to provide a novel and improved free-standing collapsible tent structure having multi-paneled opposed sidewalls bridged by a domed multi-segmented roof.

A second objective is the provision of a hub assembly for the frame panels that is made up of three or more hingedly interconnected strut-receiving subassemblies formed into a closed polygonal loop.

Another object is to provide a hinge member which has a channel mounting the strut-receiving socket for limited tiltable movement that cooperates with the hinge pins on both ends thereof to accept and retain said socket in assembled relation.

Still another objective is the provision of a self-adjusting hub assembly including four or more hingedly interconnected links operative to accommodate various included angles between adjacent strut pairs.

An additional object is to provide a novel socket for releasably connecting the strut ends to the hub and strut end fittings.

Further objects are to provide a foldable subframe construction for free-standing tends and the like that is simple, inexpensive, versatile, readily adaptable to various polygonal panel shapes and sizes, lightweight, rugged, safe and reliable.

Other objects will be in part apparent and in part pointed out specifically hereinafter in connection with the description of the drawings that follows, and in which.

Figure 1:
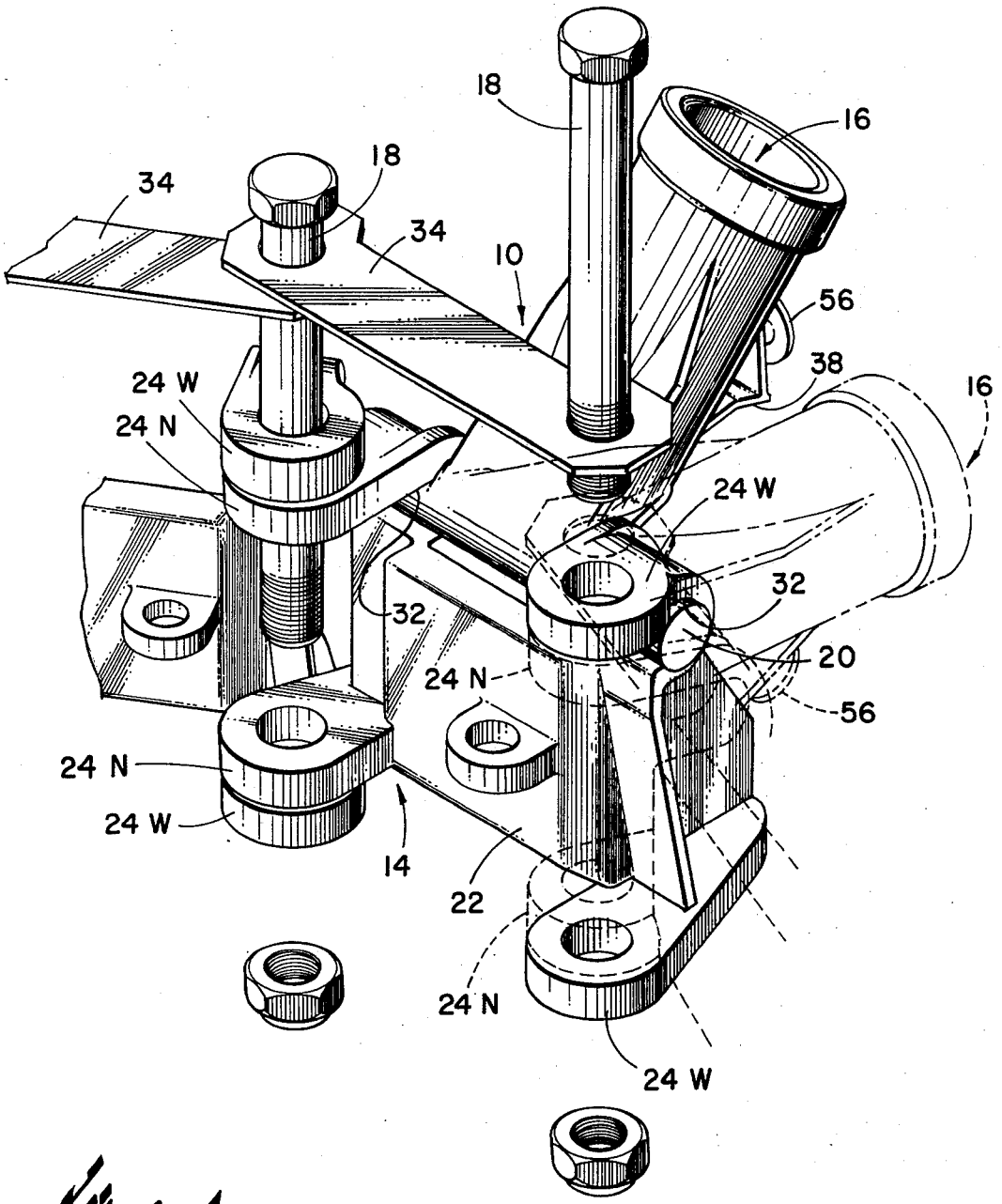
FIG. 1 is an exploded perspective view of a portion of the hub assembly showing the manner in which three or more of the strut-receiving socket subassemblies can be hingedly interconnected and ultimately formed into a closed polygonal loop.

Referring next to the drawings for a detailed description of the present invention and, initially, to FIGS. 1–5 for this purpose, reference numeral 10 has been selected to broadly designate the strut-receiving socket subassemblies which are hingedly interconnected to one another so as to form a closed loop having three or more sides that cooperate with one another when so connected to define a hub assembly generally characterized by reference numeral 12. Each of the three or more socket subassemblies 10 are identical and consist of a hinge member broadly referred to by reference numeral 14, the strut-receiving socket similarly denoted by reference numeral 16, a pair of hinge pins 18 and a pivot pin 20 which is, in the particular form shown, formed integral with the socket.

Figure 2:
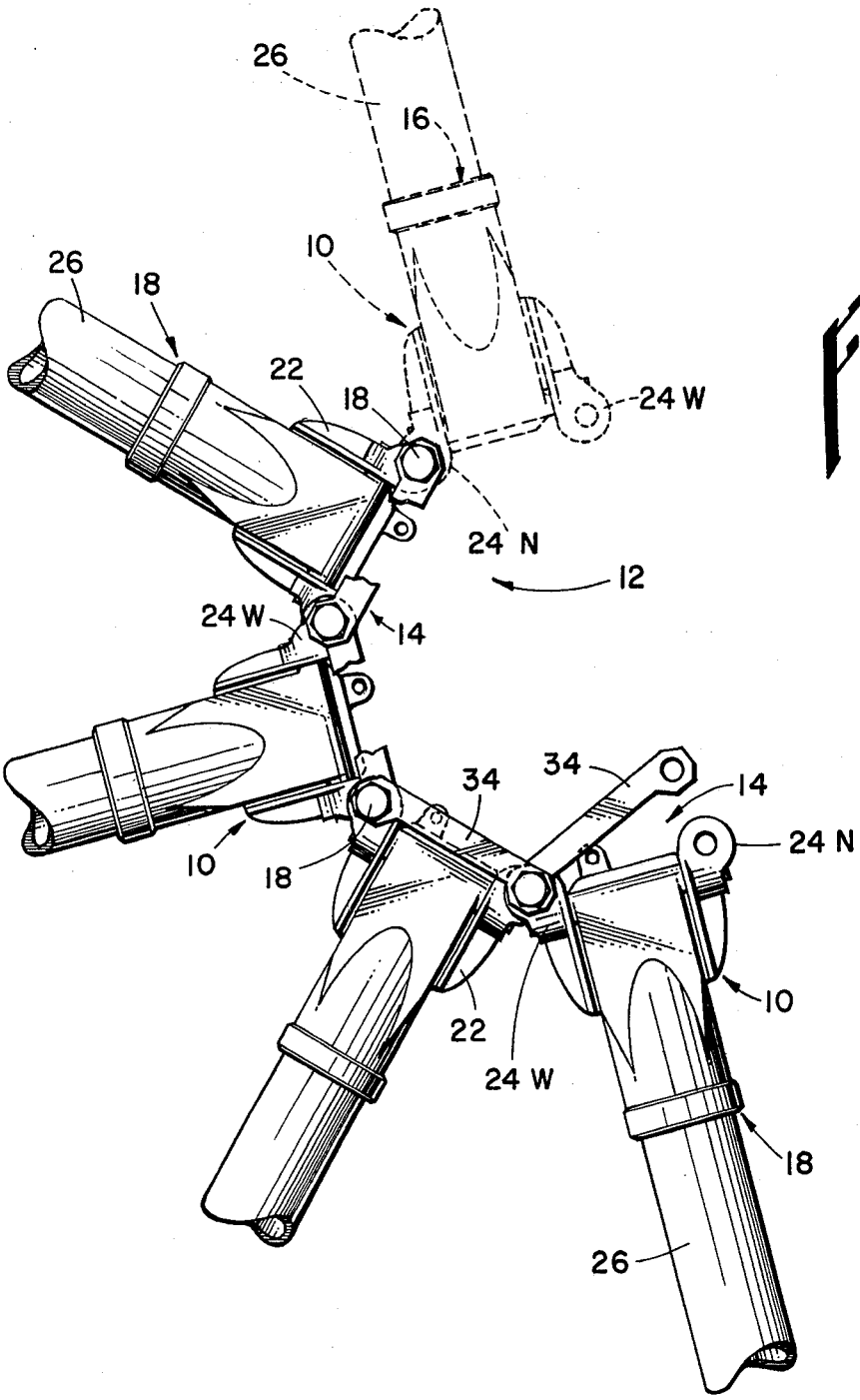
FIG. 2 is a plan view to a reduced scale showing several of the strut-receiving socket subassemblies linked together to form a chain thereof preparatory to completion of the hub by closing the loop.
Figure 4:
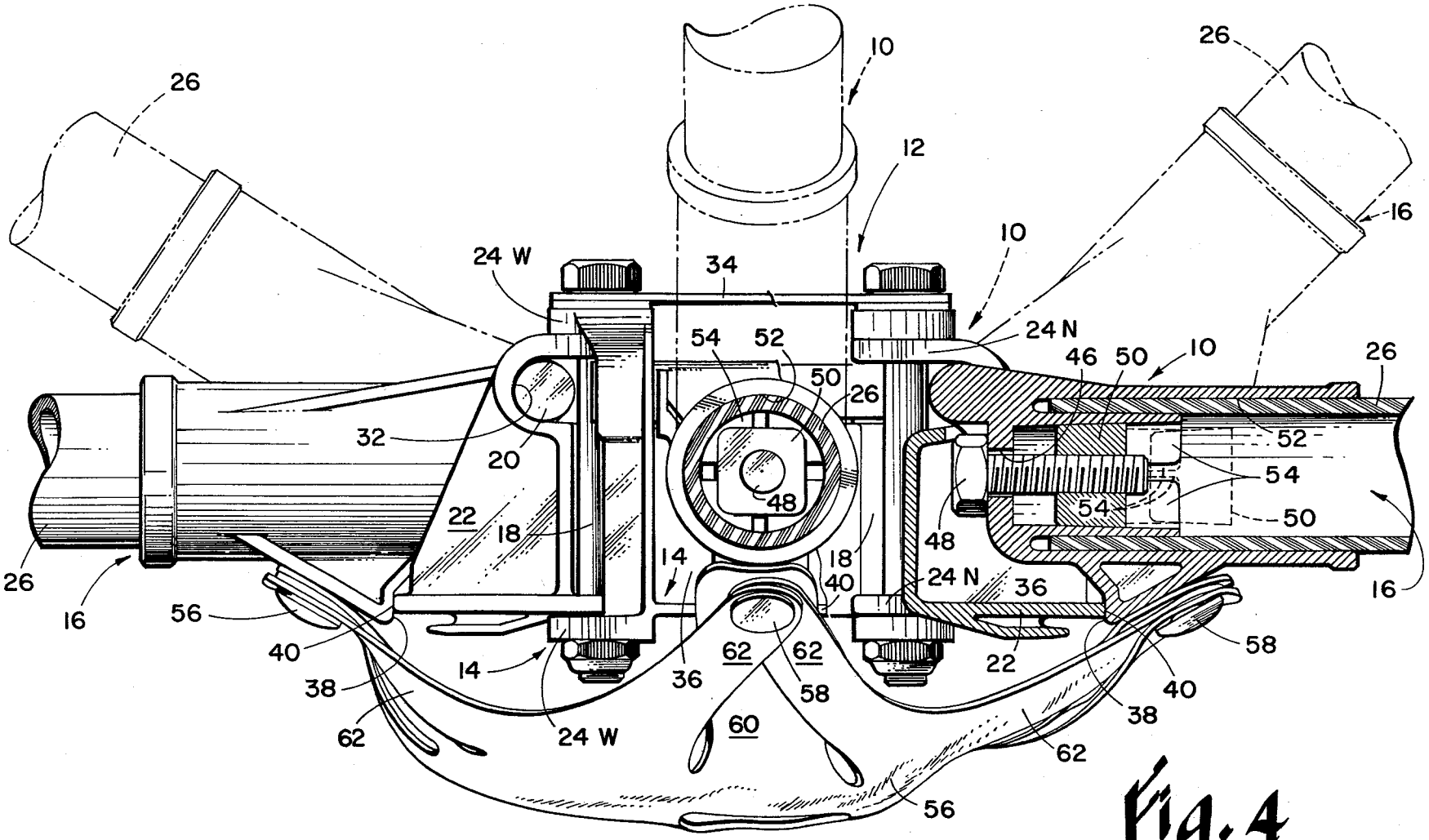
FIG. 4 is a side elevational view portions of which have been broken away and shown in diametrical section depicting the four-sided hub assembly of FIG. 3.

Hinge member 14 seen most clearly in FIGS. 1 and 4 comprises in the particular form shown a cast body 22 having opposite ends thereof provided with pairs of apertured ears 24, each pair of which is designed to accept and retain one of the hinge pins 18 in spaced parallel relation to one another. The set of ears 24W on one end of the body are spaced more widely apart than the pair 24N on the opposite end so that the latter fit between the former when linked together in end-to-end relations as illustrated most clearly in FIG. 1. With the pairs of ears of adjacent hinge members thus nested so that their apertures are aligned, hinge pins 18 complete a chain thereof as best seen in FIG. 2. Obviously, if only three such hinge members are linked together to form a closed loop, the resulting polygon will be rigid and in the form of an equilateral or isoceles triangle where the struts 26 projecting therefrom have included angles therebetween of 120° more or less.

Figure 5:
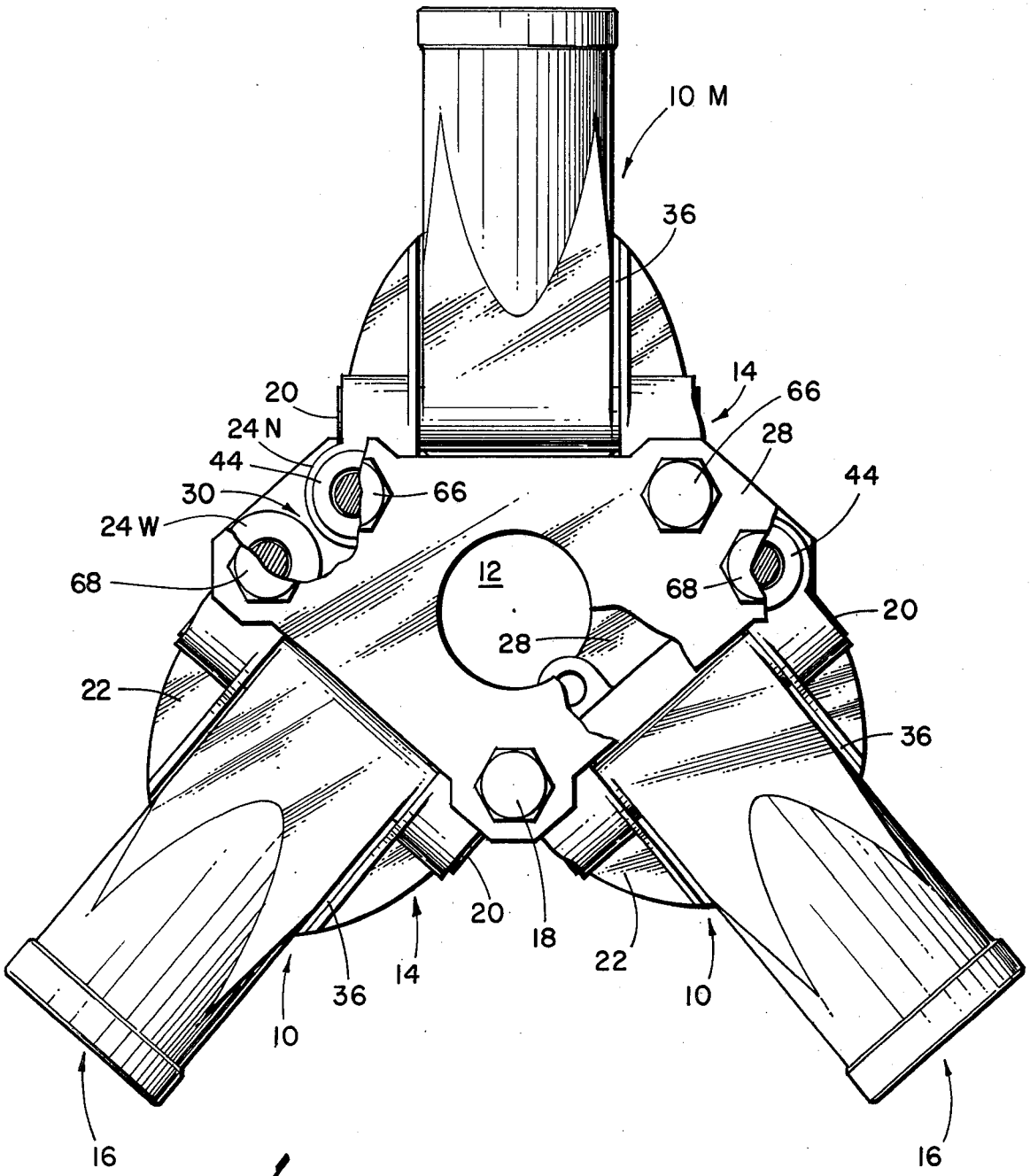
FIG. 5 is a plan view similar to FIG. 3 and to the same scale showing the three-sided rigid hub assembly fitted with the spacer plate used to widen the included angle between two of the adjacent strut pairs beyond 120° while narrowing the third, portions having been broken away to more clearly reveal the internal construction.
Figure 6:
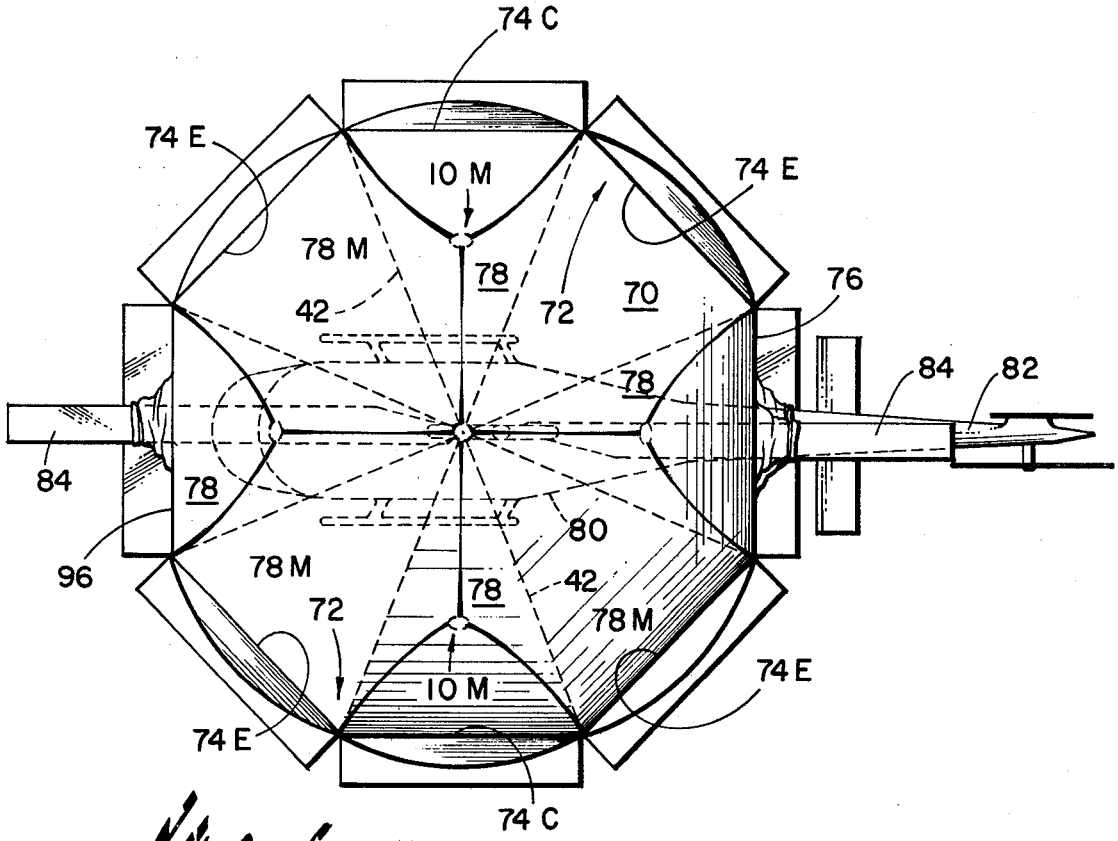
FIG. 6 is a top plan view showing one type of free-standing collapsible frame that can be erected to bridge the gaps left between opposed sidewalls using the three and four-sided hub assemblies of FIGS. 2 and 4; and, FIG. 7 is a side elevation of the FIG. 6 frame.

With brief reference to FIG. 5, it can be seen that triangular configuration having other than included angles of 120° require the use of apertured plates 28, both top and bottom, that bridge the gap 30 left between adjacent pairs of ears 24W and 24N when they are not nested one inside the other. Nevertheless, all the triangular configuration remain rigid while those polygonal hub assemblies of four or more sides are self-adjusting as indicated by the full and phantom line representations in FIG. 3 to accommodate included angles between adjacent struts 26 of other than 360/n where n is the number of hinge elements. FIG. 6, for example, is illustrative of a rectangular wall panel where the included angles between adjacent struts at the sides of the panel are obtuse while those at the top and bottom are acute, yet, no bending or bowing of the struts is required. The four-element hub-forming polygon at the center of the panel, of course, assumes a diamond-shaped configuration like that shown in full lines in FIG. 3 rather than a square one shown in phantom lines when adjacent struts are other than in right-angular relation to one another.

Returning to FIGS. 1 and 4, it will be seen that a pin-receiving channel 32 is provided where the ears 24N and 24W on the same side of the body join the latter. Channel 32 opens toward the hinge pins 18 and cooperates therewith when the latter are in place to hold pivot pin 20 in place while, at the same time, holding the entire socket subassembly 10 in assembled relation. Rigid steel links 34 apertured at their opposite ends link adjacent hinge pins 18 of the polygonal closed loop together along the sides of the hinge bodies containing the channel 32 and function as braces to reinforce the subassembly and prevent the ears 24 from breaking off due to the strain placed thereon.

As is most clearly revealed in FIGS. 1 and 4 to which continued reference will be made, it can be seen that the hinge body has the pivot pin channel 32 running along one side margin thereof perpendicular to the axes of both hinge pins 18 and offset outwardly thereof so that the latter can function in the aforementioned hinge-retaining capacity. In addition as shown in FIG. 4, each hinge body includes a pocket 36 located on the opposite side margin of the body to that containing channel 32 and opening toward the latter but at right angles thereto. As the strut-receiving socket 16 pivots within channel 32 in the hinge member on pivot pin 20 between its fully unfolded overcenter position shown in full lines in FIG. 4 and the partially folded position shown in phantom lines in this same figure, it moves from a position within pocket 36 where foot 38 on the undersurface of the socket engages stop 40 extending along the outside edge thereof to an unseated position out of engagement with the aforementioned stop.

When in the fully unfolded position shown most clearly in full lines in FIG. 4, all the strut-receiving sockets 16 are seated against their respective stops 40. As these sockets and the struts 26 carried thereby move from the fully folded position where they nest together in essentially parallel relation to one another and perpendicular relation to the plane of the hub defined by the closed loop of hinge members 14 into the fully unfolded position, each swings through an arc of slightly over 90° so that they pass through the hub hinge plane into an overcenter condition maintained by the cable 42

(FIGS. 6 and 7) connecting their remote free ends. This cooperative action between the cable, the hub and the struts is not new but instead is essentially the same as I have used for years in those subframes bordered by non-stretchable cables. Cable tighteners (not shown) of conventional design are employed to maintain the cables under proper tension and the subframes of which they form an integral part in fully unfolded overcenter position.

Thin walled plastic tubing is ideally suited for use as the strut material since it is lightweight and will flex and bend to a degree under load without breaking. The socket member 16 as shown in FIG. 4 has a central aperture 46 in the inner blind end thereof that receives the threaded shank of a bolt 48 upon which is threaded a tapered plug 50. Surrounding aperture 46 in spaced relation inside the cylindrical socket wall 52 are a plurality of spring fingers 54 which, in relaxed position will pass the strut wall into seated relation in the bottom of the socket. Rotating bolt 48 in a direction to draw the tapered plug 50 inward, spreads the fingers 54 and pinches the tube end against the inside wall of the socket thus detachably and securely fastening same in place without adhesives or other more conventional fastening techniques. Similar socket fittings (not shown) are used on the remote ends of the struts where they connect onto the cable 42.

In the preferred embodiment of the invention shown in FIG. 4, I employ a rubber sheath 56 buttoned onto the integral cleats 58 provided on the underside of each socket 16 in position to cover the entire hub. This sheath functions both as a safety feature to keep the operator's fingers out of the hub (actuation is accomplished by grasping a strut) and also as a protective cover to keep each such hub from abraiding against another lying adjacent thereto when all are folded up and nested together. Center flaps 60 of the sheath extend along the underside of the socket while flap pairs 62 are overlapped at the cleats in position to cover the center flap.

Figure 3:
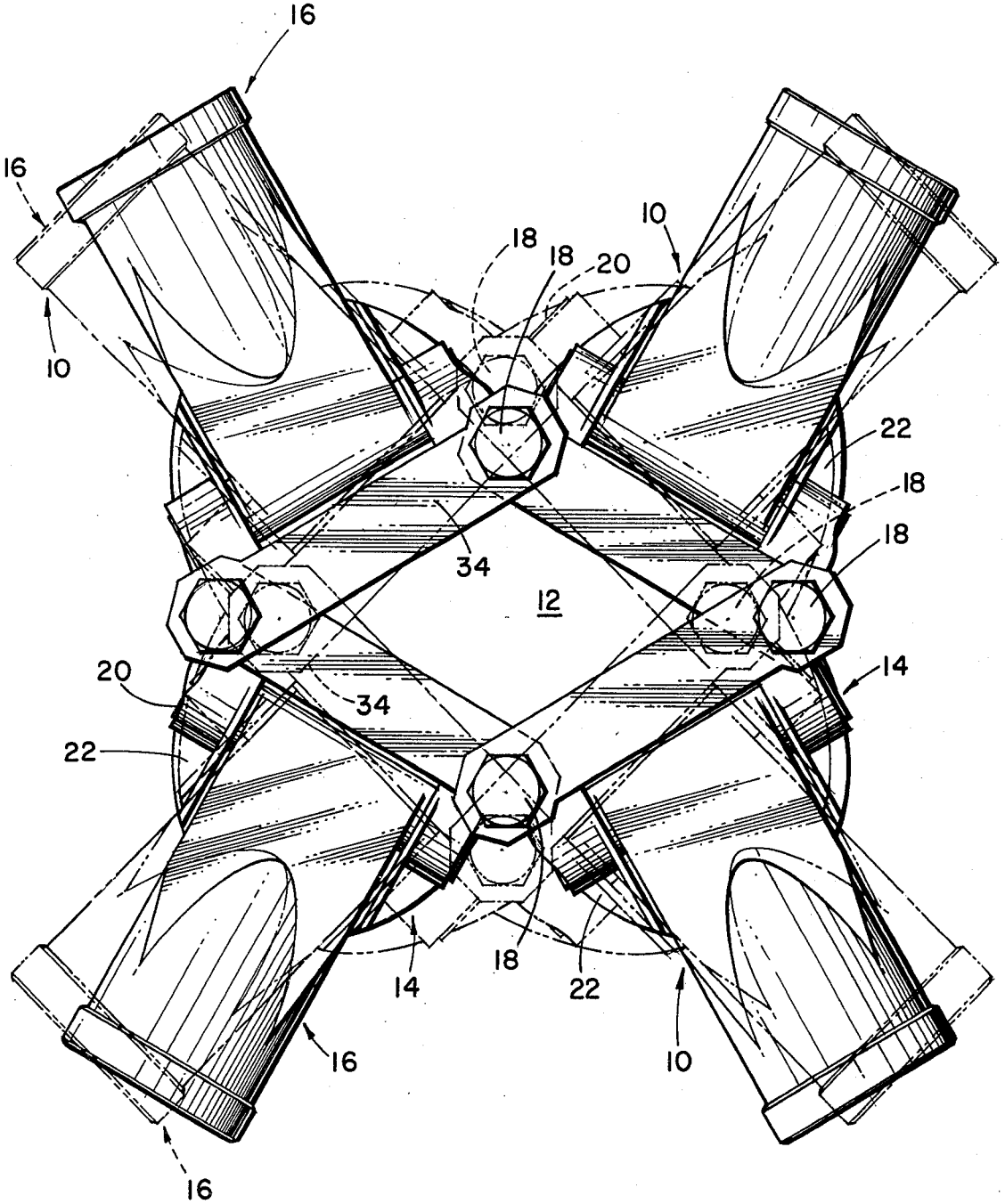
FIG. 3 is a plan view of a four-sided hub assembly to approximately the same scale as FIG. 1 showing its self-adjusting feature in full and phantom lines.

Hinge pins 18 function to link the socket subassemblies together so that four or more thereof when formed into a closed loop like that shown in FIG. 3 are free to hinge relative to those on either side thereof thus accommodating different internal angles between adjacent struts. The ears of the sockets being of cast metal are best backed up and reinforced with steel links like 34 or the apertured plate 28 of FIG. 5 as previously noted.

Looking more closely at FIG. 5, it will be seen that by connecting two of the hinge members 14 together with a single hinge pin 18 and moving the two hinge members thus connected closer together so as to define an included angle therebetween of less than 120°, a gap 30 is left between them and the third hinge member at the top. Spacer plate 28 has as its sole function that of bridging the gaps 30 between the third of the three hinge members 14 and the other two which are interconnected by common hinge pin 18. One pair of bolts 66 fasten plate 28 to the ears 24W and 24N of the third hinge member while a second pair 68 do likewise with the unused ears of the remaining two. The resulting triangular hub, while rigid and unable to self-adjust to accommodate different included angles between struts will, nevertheless, provide for other than 120° strut angles between adjacent struts of the three-sided system. Where spacer plates 28 are employed to bridge the gap 30 left between adjacent hinge body ends, washers 44 are needed to fill the gaps above the narrowly spaced ears 24N normally occupied by ears 24W.

Figure 7:
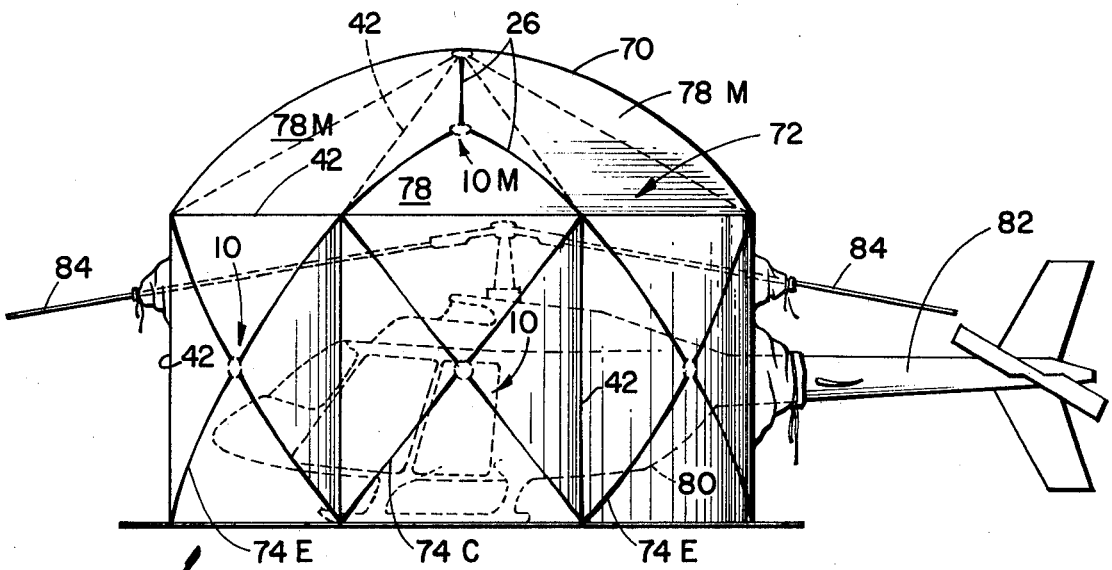

In FIGS. 6 and 7, the three-sided hub 10M of the multi-segmented domed top 70 are of the same construction shown in FIG. 5 while the four-sided ones 10 are like those of FIG. 3. Two upstanding wall structures indicated in a general way by reference numeral 72 are, in the particular form shown, comprised of three rectangular subframes 74 linked together in side-by-side relation. These two walls are separated by gaps 76 (FIG. 6) at both ends and, as such, while they would stand up in much the same way as a folding screen, they are unstable and easily pushed over. Stability is restored, however, by the unobvious expedient of bridging the gaps 76 therebetween with the domed roof 70 formed by isoceles triangular segments 78 and 78M. The unique feature is, of course, that only alternate segments 78 require the subframe defined by triangular hub 10M, three struts 26 and the cable 42 reaved around the remote ends of the latter whereas, the intermediate segments 78M have no such framing, only cable 42 that is common with the segments 78 on both sides thereof and the rectangular end panels 74E along the bottom. Center panel 74C is connected to the base of framed panel 78. Thus, the roof 70 is an octagon having triangular subframes 78 bridging the gaps 76 between the sidewalls as well as the middle panel 74C of the three-panel sidewalls 72 while the unframed triangular segments 78M share the top cable 42 of the end panels 80 and have no other internal faming. The resulting frame is just as rigid as if the gaps were bridged by subframes 74. The simplest free-standing unit of the type shown in FIGS. 6 and 7 would have three four-sided wall sections arranged in partially folded position to leave a gap between the end panels 74E and a domed roof 70 consisting of four triangular segments, two of which 78M would have no internal subframes and connect onto the top of the end wall panels 78E while the remaining two triangular panels 78M would extend along the top of the gap 76 and also along the top of the middle wall panel 78C, thus providing an internally-braced of framed rigid triangular segment 78 alongside each unframed panel 78.

FIGS. 6 and 7 show how a tint-like collapsible framed structure like that forming the subject matter of the instant invention could be used to house and shelter a helicopter 80 with its tail 82 and folded main blades 84 sticking out through the opposed openings 76 bridged by the rigid framed triangular roof segments 78. The resulting free-standing structure is devoid of internal supports and can be both erected and taken down by one person in a matter of minutes.

What is claimed is:

1. For use with four or more radially-extending struts and a tension member interconnecting the ends thereof to produce a collapsible subframe for a tent structure or the like, the improved hub assembly which comprises: a chain of at least four double-ended hinge members pivotally interconnected at their adjacent ends to form a closed polygonal loop thereof, the axes of pivotal movement between said hinge members paralleling one another in perpendicular relation to the plane of the loop; and, a strut-receiving socket attachable to each of the hinge members for pivotal movement relative thereto about an axis paralleling the plane of the loop on the outside thereof, said strut-receiving sockets being movable between a fully-folded position in substantially parallel relation to one another and a fully-unfolded position abutting their respective hinge members so as to define an included angle with respect to their fully-folded positions of slightly in excess of 90°, and the pivotal connections between adjacent hinge members cooperating with their respective strut-receiving sockets when so connected to permit adjustment of the included angle between the latter through an angle of approximately 0° and between 90° and 180° in fully-unfolded position.

2. The improved hub as set forth in claim 1 wherein: said hinge members include a channel mounting the sockets for pivotal movement extending perpendicular to the pivotal connections at the ends of the hinge members and opening toward the latter from a location outside thereof, and wherein said pivotal connections at the ends of the hinge members are defined by hinge pins cooperating with one another and with their respective hinge members when in place therein to maintain the sockets in assembled relation within their channels.

3. The improved hub as set forth in claim 1 wherein pairs of apertured ears are provided in each hinge member for receiving hinge pins and cooperating therewith to define the axes of pivotal movement at the ends thereof, the ears on one end being spaced to receive those on the other end of the adjacent hinge member therebetween in a staggered relation such that said hinge members remain transversely aligned.

4. The improved hub as set forth in claim 1 wherein: each socket includes a plurality of springable fingers extending toward the open end thereof in spaced relation to the interior socket wall so as to define an annular space sized to receive a tubular strut, wherein a tapered plug is housed between the fingers of a size and shape effective to spread the latter apart and pinch a strut end encircling same against the socket wall upon relative axial movement inwardly of said open end, and means interconnecting said socket and plug operative upon actuation to shift the latter axially.

* * * * *